United States Patent [19]

Nash et al.

[11] Patent Number: 4,792,413

[45] Date of Patent: Dec. 20, 1988

[54] NOVEL CLEANING COMPOSITION FOR REMOVAL OF PCBS

[75] Inventors: James E. Nash, Dellwood; Kurt E. Heikkila, Circle Pines, both of Minn.

[73] Assignee: Capsule Environmental Engineering, Inc., St. Paul, Minn.

[21] Appl. No.: 123,373

[22] Filed: Nov. 20, 1987

Related U.S. Application Data

[63] Continuation of Ser. No. 920,275, Oct. 17, 1986, abandoned, which is a continuation-in-part of Ser. No. 689,336, Jan. 7, 1985, abandoned.

[51] Int. Cl.[4] ..... C11D 3/44; C11D 7/52

[52] U.S. Cl. ..... 252/111; 252/114; 252/118; 252/162; 252/166; 252/167; 252/170; 252/171; 252/DIG. 14; 134/40; 134/41

[58] Field of Search ..... 252/111, 114, 118, 112, 252/162, 166, 167, 170, 171, 174.24, 139, 525, 527, 540, 544, 546, 153, 158, DIG. 14, 109, 110; 134/2, 12, 36, 38, 40, 41

[56] References Cited

U.S. PATENT DOCUMENTS

| | | | |
|---|---|---|---|
| 2,356,747 | 8/1944 | Bowman et al. | 252/111 |
| 2,929,789 | 3/1960 | Pickett et al. | 252/153 |
| 4,425,949 | 1/1984 | Rowe, Jr. | 134/11 |
| 4,483,717 | 11/1984 | Olmsted et al. | 134/11 |
| 4,610,729 | 9/1986 | Keane | 134/26 |

FOREIGN PATENT DOCUMENTS 7106287 11/1971 Netherlands .

OTHER PUBLICATIONS

Carbide, McGraw-Edison join to clean up PCBs, C&EN, Sep. 24, 1984.

Solv G., Union Chemicals Division, Petrochemical Group, Sep. 25, 1984.

Penesolve 814, Material Safety Data Sheet, U.S. Dept. of Labor, May 1969.

Chemical Treatment of PCBs in the Environment, C. J. Rogers, U.S. Environmental Protection Agency, Pre 01/85.

TSCA, Polychlorinate Biphenyls, Penalty Policy, The Bureau of National Affairs, Inc. 251:801, 1980.

Protection of Environment, The Environmental Protection Agency, pp. 442-443, Pre 01-85.

The PCB Regulations under TSCA, The Environmental Protection Agency, pp. 6-16, 08-83.

Goodyear develops PCB removal method, C&EN, p. 9, Sep. 1, 1980.

PCB Labeling, Labeling and Packaging, The Bureau of National Affairs, Inc., 225:501-502, 10-28-82.

PCB Labeling, The Bureau of National Affairs, Inc., 225: 511-512, 04-14-83.

Toxic Substances Control Act, Authorized PCB Uses, Manufacture and Use, The Bureau of National Affairs, Inc., 201: 1001-1002, 1005-1007, 08-16-84.

Authorized PCB Uses, Premanufacture and Use, The Bureau of National Affairs, Inc., 201: 1003-1004, 06-0-9-83.

Polychlorinated Biphenyls, National Academy of Sciences, Wash, D.C., 1979.

Studies on the Absorption of Selected Polychlorinated Biphenyl Isomers on Several Surfaces, Hague & Schmedding, J. Environ. Sci. Health Bll. (2), 129-137 (1976).

ENR/Oct. 18, 1984.

*Primary Examiner*—Paul Lieberman
*Assistant Examiner*—Hoa Van Le
*Attorney, Agent, or Firm*—Vidas & Arrett

[57] ABSTRACT

Removal and/or clean-up of polychlorinated biphenyls (PCBs) from contaminated surfaces with novel compositions of petroleum distillate and wetting agent mixtures.

2 Claims, No Drawings

NOVEL CLEANING COMPOSITION FOR REMOVAL OF PCBS

This is a continuation of application Ser. No. 920,275, filed Oct. 17, 1986, which was a continuation-in-part of application Ser. No. 689,336, filed Jan. 7, 1985, now abandoned.

BACKGROUND OF THE INVENTION

The use of Polychlorinated Biphenyls (PCBs) in industrial environments and governmental regulations for PCB use has created a need for effective PCB removal. The cleanup of PCBs has heretofore been primarily accomplished with the use of kerosene, a like-polarity solvent for PCBs. Kerosene has had widespread use but has several drawbacks including the volatile nature of the solvent, difficulty in both application and removal of the solvent from surfaces plus minimal extraction efficiency. The difficulty in the removal of the PCB-laden kerosene from surfaces is due to the lack of solvent miscibility with water in the final water rinsing. The kerosene removal problem has resulted in making PCB cleanup labor intensive.

Accordingly, a substantial need exists for PCB cleaning compositions which are easy to apply, are water miscible for rinsibility, and which have higher extraction capability for PCBs. Cleaning compositions with these attributes are more effective and will reduce the manpower needed for PCB removal. This invention provides such compositions. The compositions provided also have a low flash point and are not toxic.

Accordingly, this invention specifically relates to the removal of Polychlorinated Biphenyls (PCBs) from contaminated surfaces and to novel cleaning compositions therefor. More particularly, the invention relates to chemical compositions in which a petroleum fraction is combined with a wetting agent fraction to render the petroleum fraction water miscible. Such compositions are extremely effective for the removal of PCBs. The compositions may be applied directly in liquid form or as a foam. The foam application has advantages over previously-used PCB cleaners in that it is effective on vertical, horizontal and overhead surfaces and has superior extraction capability, and is effective in reduced application volumes. The reduction in volume of PCB-laden solvent is an important factor in PCB clean-up due to the need for its containment and subsequent disposal or destruction.

SUMMARY OF THE INVENTION

In accordance with this invention, it has been discovered that combinations of certain petroleum distillates and certain wetting agents provide compositions with the solvent extraction capability of a pure hydrophobic solvent. The petroleum distillates used can be of higher molecular weight and have a higher affinity for PCBs than the kerosene-type solvents used heretofore. The formulations allow the use of the high molecular weight solvent without sacrificing the ease of removal that is inherent with lower molecular weight petroleum fractions.

The compositions of the invention offer the miscibility of aqueous-based cleaning compositions with increased extraction efficiency for PCBs due to the petroleum fraction. The viability of these compositions is made possible by the use of a wetting agent fraction which combines the petroleum fraction and water into a stable formulation. The wetting agent fraction gives the compositions the additional capability of being applied as a foam blanket. The use of the product as a foam allows for overhead and vertical applications and provides enhanced PCB extraction. The foam also reduces the volume of material needed for PCB removal which is a means for both a reduction in labor and in disposal of waste material.

The PCB extraction compositions of the invention include: petroleum distillate and wetting agent. Additionally, the compositions may include: metal surface protectors, inorganic complexation agents, and water, for dilute application.

DESCRIPTION OF PREFERRED EMBODIMENTS

In greater detail, the compositions of the invention include essentially the following functions or components:

1. petroleum distillates/solvents, i.e., a high boiling petroleum fraction aromatic hydrocarbon solvent having a polarity similar to PCBs and chain lengths of from about $C_9$ to about $C_{12}$; and
2. a carboxylic acid type of wetting agent.

The compositions of the invention may be applied in a "neat" formulation or , with added water as a diluent or in a foam blanket. Water is preferably included prior to use as a diluent.

The solvent and wetting agent fractions are preferably mixed in approximately the proportions required to render them water miscible and provide solvent characteristics suitable for the amount of PCBs to be removed and for the amount involved i.e., heavy or light concentration. These proportions will depend on the specific solventy and wetting agent selected. This can be readily determined by trying a few sample mixtures on the removal site.

Generally speaking, the aromatic hydrocarbon solvent fraction will be present in approximately a weight percent range of from about 20 to about 80% (about 70% being preferred) and the wetting agent fraction will be present in approximately a weight percent range of from about 10% to about 40% (about 30% preferred). The upper limit of the amount of solvent is limited and controlled in large part by the fact that the water miscibility of the compositions tends to decrease in the higher solvent amounts. The upper limit on the wetting agent fraction is more difficult to define specifically but tends to be limited by stability considerations of the composition mixture.

The preferred aromatic hydrocarbon solvent is AMSCO Solvent G marketed by Union Oil Co. of LaMerada, Calif. This solvent consists of:

6.2% $C_9$ alkyl benzenes
67.5% $C_{10}$ alkyl benzenes
10.3% $C_{11}$ alkyl benzenes
0.7% $C_{12}$ alkyl benzenes
15.0% Indanes and tetralines
Balance is other aromatic hydrocarbons.

Aromatic hydrocarbon solvents other than AMSCO Solvent G may also be used if the chain length is suitable i.e., between $C_9$ and $C_{12}$ and the polarity is appropriate, i.e., similar to the polarity of the PCB's. For example, any of the alkyl benzenes listed above may be used individually or in sub-combinations, the $C_{10}$ length being most preferred. The substituted versions of these hydrocarbons may be used as well, such as amine, sulfonic and phosphoric substituted versions. The term "aromatic hydrocarbon solvent" is used herein to indicate all of the solvents of the type described above.

In situations involving PCB cleanup in which heavier concentrations of PCB are involved, it is preferred that up to about 15 weight % of cyclohexanol (in terms of overall composition before any water is added, i.e., "neat") or other aromatic and straight chain alcohol compounds be included as part of the solvent fraction of the composition. These are miscible with most oils and aromatic hydrocarbons.

A third type of solvent addition is also desirable in many PCB removal applications. This solvent addition is preferably ethylene glycol monobutyl ether, commercially available from Union Carbide Corp. of New York as Butyl "Cellosolve" (a trademarked product), but acetone or methylisobutyl ketone may also be used. This solvent addition may range up to about 15 weight % in terms of overall composition.

The preferred wetting agent fraction is obtained by combining a fatty acid oil having a chain length of $C_{10}$ to $C_{20}$ with ammonia, one of its derivatives: ethylamine, methylamine, ethyleneamine, diethyleneamine, dimethylamine, monoethanolamine, diethanolamine, triethanolamine or one of the substituted forms of the derivatives as follows: trihydoxyalkylamines, monohydroxyalkylamines or dihydroxyalkyl amines wherein the chain length of the alkyl group is $C^2$ to $C^{20}$. Examples are monohydroxyethylamine, trihydroxyethylamine, and dihydroxyethylamine. The ammonia derivatives are preferred, monoethanolamine being the most preferred. The relative amounts of fatty acid oil or carboxylic acid to ammonia or derivative may vary over the ranges of about 30–86 weight percent for the former and about 14–70 weight percent for the latter, about 60% and 40%, respectively being preferred, particularly when AMSCO Solvent G and monoethanolamine are used. Tall oil, most preferably potassium tall oil, and animal and vegetable oils such as coconut, corn, cottonseed, lard, olive, palm, peanut, soybean, cod liver, linseed and tung oil may be used as the fatty acid oil. The active constituents of these oils are believed to be the carboxylic acids: linoleic acid, oleic acid and abietic acid, all of which are within the chain length range of $C_{10}$ to $C_{20}$. They can be synthesized and combined individually or in mixtures directly with the ammonia or ammonia derivative or substituted derivative also. As an additional wetting agent, phosphate esters may be additionally combined with the ammonia or ammonia derivative or substituted derivative. Phenol ethoxylates may be additionally included also, as can most common nonionic surfactants.

It may at times be desirable to include a sulfonic acid in the cleaning composition in order to promote stability of the overall composition. This will be especially desirable when the aromatic hydrocarbon solvent exceeds about 50% by weight of the overall composition (without water added). Although any sulfonic acid ($R\text{-}SO_3H$) may be used, benzene sulfonic acid is most preferred. The amount may range up to about 20 weight % of the overall composition (without added water).

Another additional ingredient which may be included is tetrapotassium pyrophosphate or equivalent, such as ethylenediaminetetraacetic acid (EDTA), hydroxyethylethylenediaminetriacetic (HEDTA), nitrilotriacetic (NTA), or other polyphosphates, where the composition is to be used in cleanup involving inorganics, soil or hard water. The practical upper limit for this ingredient is about 5 weight % of the overall composition (without added water).

Lastly, in those instances where the cleanup involves metal surfaces, sodium metasilicate pentahydrate up to about 5 weight % of the overall composition (without added water) or other addition agents such as benzatriazole or other imidizole compounds, may also be included for passivation of the metal surfaces in similar amounts of up to about 5 weight percent.

Although the compositions described above may be prepared for shipment as described i.e., "neat" and may be used in that form, they will most likely be used in a dilute form, the diluent being water. Dilution ratios will vary over a wide range depending upon the clean-up problem to be dealt with; 1:20 is a typical dilution range.

The following Example I represents the most preferred cleaning composition. This particular composition has the advantage of being capable of being foamed by agitation and air mixing. Several types of air agitation or venturi-type systems ranging from air/chemical pressurized solution chambers to power-driven air/chemical pumps are well known and may be used for this purpose. The ability to foam is an important feature of these compositions because on application of a foam to a surface, particularly such as a ceiling or wall, the foam attaches to the surface and allows extended contact and dwell time for thorough cleanup. The particular preferred composition described below is foamed by diluting 1 part of the composition with 5 parts of water. Other ratios will be useful, again depending on the circumstances.

EXAMPLE I

| Constituent | Weight % |
|---|---|
| AMSCO Solvent G | 58.0 |
| Butyl "Cellosolve" (ethylene glycol monobutyl ether) | 6.5 |
| Cyclohexanol | 4.0 |
| Potassium Tall Oil | 13.0 |
| Monoethanolamine | 8.0 |
| Sulfonic Acid (neutralized with potash) | 8.0 |
| Sodium Metasilicate Pentahydrate | 0.5 |
| Tetrapotassium Pyrophosphate | 2.5 |

EXAMPLE II

A typical dilution for general foam application is represented by the following variation in Example I.

| Constituent | Weight % |
|---|---|
| AMSCO Solvent G | 7.5 |
| Butyl "Cellosolve" | 1.0 |
| Cyclohexanol | 0.5 |
| Potassium Tall Oil | 1.5 |
| Monoethanolamine | 1.0 |
| Sulfonic Acid (neutralized with potash) | 1.0 |
| Sodium Metasilicate Pentahydrate | 0.1 |
| Tetrapotassium Pyrophosphate | 0.4 |
| Water (soft) | 87.0 |

Note: This is a typical 1:5 dilution.

Typical Cleanup Results

Using the composition of Example II in the foam form, the following results were obtained:

A. A loading dock area exhibited a reduction of PCB contamination from 7.9 ug/200 $cm^2$ to 4.1 ug/200 $cm^2$, and B. An injection molding area exhibited a rejection of PCB contamination from 26 ug/200cm$^2$. The supporting data for these tests are shown in Table I below.

TABLE I

| Sample | Gas Chromatographic RT of PCB 1248 - constituents 1.50 | 1.86 | 2.25 | 2.60 | 2.76 | 3.19 | 3.70 | Area Avg. | Sample Volumes | 1248 PCB Concentration ug/200 cm$^2$ |
|---|---|---|---|---|---|---|---|---|---|---|
| 109 Loading Dock Preclean | 3.708 | 6.035 | 13.050 | 18.444 | 17.447 | 20.499 | 25.032 | 15 | FV 1.08 ml 5 ul inj. | 7.9 |
| 115 Loading Dock Post Clean | 3.285 | 4.023 | 7.727 | 9.858 | 9.764 | 11.153 | 13.422 | 8.5 | FV .96 ml 5 ul inj. | 4.1 |
| 112 Injection Molding Preclean | .346 | .308 | .512 | .623 | .490 | .470 | .581 | .47 | Dil. 1 to 100 FV 1.1 ml 5 ul inj. | 26 |
| 120 Injection Molding Post Clean | 4.430 | 6.610 | 10.355 | 13.303 | 8.836 | 13.394 | 12.597 | 9.9 | FV 1.01 5 ul inj. | 5.0 |

In these tests, PCB samples were taken, then the PCB-laden surfaces received a foam application of the composition at a 1:5 dilution. The foam was then given a minimum of a 5-minute dwell on the surfaces. The composition was then vacuumed up; samples were taken; the surfaces were rinsed with water and the rinse solution was removed, by vacuum. At this point, second PCB samples were taken from the surfaces to determine the extent of PCB removal.

The following experimental procedures were utilized:

1. PCB Surface Sample Collection Method

Chain of Custody forms were completed for all samples collected. The following describes the sample method used for collection of swab samples for PCB analyses.

Swab Test a. Using template, mark corners of 20×10 cm. square in desired sample area. Number the square for future reference.

b. Put on pair of clean disposal latex gloves.

c. Fold a tissue, e.g., Kimberly Clark's "Kim Wipe" to about 1 inch×1 inch, hold in tweezers and soak with hexane.

d. Swab area four times using tweezers and tip of one finger to hold "Kim Wipe". Fold tissue over after each third time.

e. Place "Kim Wipe" in sample container (new glass container with foil in lid).

f. Rinse tweezers and finger tip with hexane into sample container.

g. Seal the sample container, complete labeling and place container in cooler.

h. Dispose of latex gloves and move to next site.

2. PCB Swab Sample Preparation Procedure a. Remove swab from container with a hexane rinsed tweezers, and place into a 125 ml erlenmeyer flask. Rinse tweezers off into flask with hexane. Label sample for identification.

b. Rinse the sample container out three times with hexane, adding rinsings to flask. Add additional hexane to reach a final volume of approximately 75 ml into the erlenmeyer flask.

c. Homogenize sample in solvent (tissumize) swab until a pulp-like consistency is obtained.

d. Decant hexane from 125 ml erlenmeyer and pass it through a hexane rinsed column, into a Kuderna Danish receiving flask. Do not let $NaSO_4$ out to the air.

e. After initial decantation, swirl erlenmeyer to squeeze remaining hexane from swab, pouring hexane into column. Do this twice. Repeat tissumizing, decantation and swirling processes two more times with approximately 50 mls hexane each. Rinse probe into erlenmeyer with hexane after final tissumizing. Let solvent run through column without letting $NaSO_4$ out into the air. As last of solvent runs down to $NaSO_4$ level, rinse down sides of column with hexane. Run solvent completely out.

f. Prewet a Snyder column with hexane and attach to Kuderna Danish flask that contains sample extract. Boil sample on steam bath at approximately 95×C to near dryness. Take off bath, drain and cool ten minutes.

g. Place concentrator tube under nitrogen gas, blowing it down to a volume of 1 ml or slightly less.

h. Transfer sample to correct 7 ml vial after checking corresponding number of concentration tube as recorded on data sheet. Record volume on log sheet and mark it on 7 ml vial label also.

i. Do an adsorbent particle cleanup, using for example, a small pariiculate, e.g., "Florisil" (trademark of Floridin Co. of Pittsburgh, PA.) on each sample and blank.

j. Repeat for all samples, taking care to clean Tekmar probe *carefully* between each sample.

3. Probe cleaning procedure

Fill three erlenmeyers one-third full with (1) deionized water, (2) acetone, and (3) hexane, and label. Start with deionized water and blend at high speed, emptying, rinsing, refilling and repeating until no tissue pieces appear in the water. (usually 3–4 times.) Next blend with acetone. Check for tissue again. If present, empty, rinse and repeat. If not, wipe down probe with a clean tissue. Blend probe with hexane and rinse down with hexane also. If any tissue remains in probe at this point, take apart and clean by hand.

Clean the hexane rinse erlenmeyer between each sample. Rinse out thoroughly with hexane before refilling. (3) PCB analysis by EPA test method 608 for organochlorine and PCBs—July 1982.

Whereas the invention has been described in detail with reference to certain embodiments for purposes of illustration, it should be understood that variations may be made without departing from the essential features of the invention which are set forth in the following claims.

What is claimed is:

1. A composition for PCB clean-up comprising:

| Constituent | Weight % |
|---|---|
| Solvent mixture | about 58.0 |
| Monobutyl Ether Ethylene Glycol | about 6.5 |
| Cyclohexanol | about 4.0 |
| Potassium Tall Oil | about 13.0 |
| Monoethanolamine | about 8.0 |
| Sulfonic Acid (neutralized) | about 8.0 |
| Sodium Metasilicate Pentahydrate | about 0.5 |
| Tetrapotassium Pyrophosphate | about 2.5 |

said solvent mixture consists of: 6.2% $C_9$, 67.5% $C_{10}$, 10.3% $C_{11}$ and 0.7% $C_{12}$ alkyl benzenes, 15.0% indanes and tetralines and balance other aromatic hydrocarbons.

2. A composition for PCB clean-up comprising:

| Constituent | Weight % |
|---|---|
| Solvent mixture | about 7.5 |
| Ethylene Glycol Monobutyl Ether | about 1.0 |
| Cyclohexanol | about 0.5 |
| Potassium Tall Oil | about 1.5 |
| Monoethanolamine | about 1.0 |
| Sulfonic Acid (neutralized) | about 1.0 |
| Sodium Metasilicate Pentahydrate | about 0.1 |
| Tetrapotassium Pyrophosphate | about 0.4 |
| Water | about 87.0 |

said solvent mixture consists of: 6.2% $C_9$, 67.5% $C_{10}$, 10.3% $C_{11}$ and 0.7% $C_{12}$ alkyl benzenes, 15.0% indanes and tetralines and balance other aromatic hydrocarbons.

* * * * *